US005314776A

United States Patent [19]

Nomura et al.

[11] Patent Number: 5,314,776

[45] Date of Patent: May 24, 1994

[54] MULTI-LAYERED PHOTORECEPTOR FOR ELECTROPHOTOGRAPHY

[75] Inventors: Shinichi Nomura, Hatano; Yoichi Fukuda, Sagamihara; Atsushi Nagasaki; Fumiyuki Suda, both of Yokohama, all of Japan

[73] Assignee: Stanley Electric Co., Ltd., Tokyo, Japan

[21] Appl. No.: 866,742

[22] Filed: Apr. 10, 1992

[30] Foreign Application Priority Data

Apr. 16, 1991 [JP] Japan ..... 3-111191

[51] Int. Cl.[5] ..... G03G 5/10

[52] U.S. Cl. ..... 430/65; 430/58

[58] Field of Search ..... 430/63, 64, 58, 59, 430/65

[56] References Cited

U.S. PATENT DOCUMENTS 4,664,995 5/1987 Horgan et al. ..... 430/64

4,859,553 8/1989 Jansen et al. ..... 430/63

*Primary Examiner*—John Goodrow

*Attorney, Agent, or Firm*—Frishauf, Holtz, Goodman & Woodward

[57] ABSTRACT

A process for manufacturing a photoreceptor for electrophotography excellent in electrophotographic characteristics such as charging properties and sensitivity, which process comprises the steps of forming on a substrate, which comprises an electroconductive support or a support having an electroconductive film thereon, a thin film composed of a material selected from the group consisting of silicon dioxide and silicon oxides, containing predominantly $SiO_2$, by deposition from the vapor phase to produce an under coat layer, and forming on said under coat layer a carrier generation layer and a carrier transport layer in this order.

5 Claims, 2 Drawing Sheets

MULTI-LAYERED PHOTORECEPTOR FOR ELECTROPHOTOGRAPHY

BACKGROUND OF THE INVENTION

1. Field of the Invention

The present invention relates to a photoreceptor for electrophotography and a process for manufacturing the same.

2. Description of Related Art

Those multi-layered organic photoreceptors which have been used heretofore as photoreceptors for electrophotography, generally have a structure comprising an electroconductive support, a carrier generation layer (CGL) formed on the support, and a carrier transport layer (CTL) formed on the carrier generation layer. There may be a case where an under coat layer (UL) is formed between the electroconductive support and the carrier generation layer, if necessary.

Materials to be used for the carrier generation layers include azoic materials and phthalocyanine based materials which are capable of generating charge carriers. Those carrier generation materials (referred to as CGM hereinunder) may be used in the form of dispersion in a binder such as polycarbonate resins and the like. Materials to be used for the carrier transport layers (i.e., carrier transport materials referred to as CTM by abbreviation) comprise a combination of hydrazone and the like capable of transporting charge carriers and a binder for enhancing mechanical strength. The under coat layers may be provided for improvement in accuracy of mechanical processing of the electroconductive supports as well as for preventing the carriers from leaking out of the carrier generation layer into the support. The under coat layers (referred to as UL hereinunder) may be formed on the electroconductive support as by a dipping technique where in general a polyamide resin is dissolved into an alcoholic solvent and then applied by dipping.

However, the UL should have a film thickness as thin as about 1 μm for inhibition of a reduction in sensitivity. For this reason, the conventional dipping method has a technical difficulty in achieving such films. If the UL is not uniform in thickness and quality, electrical properties of the organic photoreceptor with the UL are uneven resulting in non-uniformity of images obtained. Therefore, there is a demand to form a uniform thin film over all the surface of the support which is not easy to achieve technically. Moreover, there is a need to use an apparatus equipped with antiexplosion means because solvents for dissolving the polyamide resins are alcoholic. In addition, the formation of the carrier generation layer on the UL requires to select deliberately such a solvents as not causing any elution of the materials out of the film so that the types of materials for use in the carrier generation layers and the carrier transport layers are limited.

SUMMARY OF THE INVENTION

An object of the present invention is to provide a photoreceptor for electrophotography comprising a substrate which comprises an electroconductive support or a support having an electroconductive film thereon, an under coat layer composed of silicon dioxide or other silicon oxides formed on said substrate, a carrier generation layer formed on said under coat layer and a carrier transport layer formed on said carrier generation layer.

The UL of silicon dioxide or silicon oxides containing predominantly $SiO_2$ can be produced from vapor phase on a photoreceptor substrate as a film having a uniform thickness of 1 μm or less.

The use of inorganic $SiO_2$ for the UL of an organic photoreceptor allows the solvent used in the carrier generation layers and the carrier transport layers to be selected from a wide variety of solvents because no material is eluted from the UL into the carrier generation layer and the carrier transport layer formed on the UL.

The novel photoreceptor for electrophotography having the UL of silicon dioxide or silicon oxides, comprising predominantly $SiO_2$, can provide superior electrophotographic properties to those obtained by the prior art. It has enhanced charging characteristics as well as superior sensitivity characteristics.

DESCRIPTION OF PREFERRED EMBODIMENTS

Figure 1A:
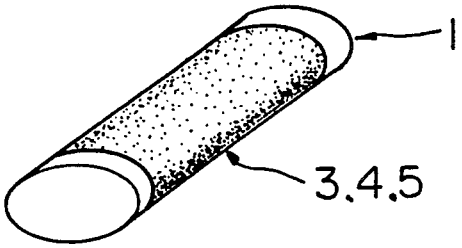
FIG. 1A is a schematic perspective view of the arrangement of a photoreceptor for electrophotography according to an embodiment of the present invention.
Figure 1B:
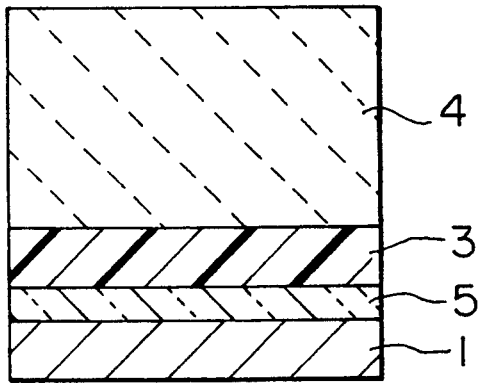
FIG. 1B is an enlarged diagrammatical cross-sectional view of a part of the photoreceptor as shown in FIG. 1A.

The present invention will be described in detail with reference to FIGS. 1A and 1B showing the photoreceptor according to an embodiment of the present invention under.

FIG. 1A is a schematic perspective view of the arrangement of a photoreceptor for electrophotography of the present invention, and FIG. 1B is an enlarged diagrammatical cross-sectional view of a part of the photoreceptor as shown in FIG. 1A. First, on an electroconductive support 1 such as an aluminum drum, there is formed an under coat layer (UL) 5 of a $SiO_2$ thin film having a thickness of 1 μm or less. Preferably, a $SiO_2$ UL having a thickness of 2 to 500 nm is formed. The $SiO_2$ thin film may be formed by any one of deposition techniques from vapor phase such as sputtering, CVD, electron beam vapor deposition, and ion plating. The term "deposition from vapor phase" as used here means a process where materials are first vaporized into a vapor phase (almost free atomic or molecular state) and then transported to be depositted.

The thickness and quality are controlled to be uniform and pinhole free on the surface of the electroconductive support. A uniform thickness may be attained by controlling relative dispositions of a source for the vaporization of materials and a support as well as by a movement of the support. A homogeneous film quality may be achieved by taking measures that no variation is caused in the composition of the source for the variation of materials along with no chemical variation occurring in the deposited film during deposition. The pinhole free film can be produced by conducting the deposition in an evacuated space where inherently no dust exists taking care not to cause deposition of foreign dust onto the depositing surfaces.

On the UL formed as described above, there is produced a carrier generation layer 3. The carrier generation layer may be produced by conventionally dispersing a carrier generating material (CGM) such as azoic compounds or phthalocyanine compounds in a binder and applying the dispersion onto the UL as by a coating technique, or preferably by depositing a film of the CGM directly by the vapor phase deposition such as vacuum vapor deposition. In this case, the UL composed of silicon dioxide or silicon oxides, containing predominantly $SiO_2$, and the carrier generation layer can be sequentially formed in an evacuated atmosphere to allow production of a high quality photoreceptor. Most preferable CGM is titanyl phthalocyanine (TiOPc).

Then, carrier transport layer 4 is formed on the carrier generation layer 3. The carrier transport layer may be produced by dissolving a carrier transport material such as hydrazone and a binder such as polycarbonate resins in an appropriate solvent and applying the solvent on the underlie as by a coating method.

In this way, there can be manufactured an photoreceptor for electrophotography having a thin uniform $SiO_2$ under coat layer on an electroconductive support.

For example, a film having a thickness of about 20 μm and a resistivity in dark ($P_{dark}$) of about $10^{14}$ to $10^{15}$ Ωcm is used as CTL and a TiOPc film having a thickness of 100 nm or less and a $P_{dark}$ of about $10^3$ to $10^5$ Ωcm is used as CGL. If no $SiO_2$ UL is provided, almost all the field applied to the photoreceptor by charging is utilized to impart a potential to the CTL. For this reason, carriers generated in the CGL by exposure to light are not effectively injected into the CTL owing to a low field across the CGL so that the photoreceptor has a low sensitivity.

Next, a case where a $SiO_2$ film is present between the substrate and the CGL, or between a transparent electroconductive film and the CGL as in the aforementioned case will be explained.

There is provided a $SiO_2$ film having a thickness of 100 nm and a resistivity of $10^{15}$ Ωcm which has a resistance per unit area:

$$R = 1\times10^{15}\times0.1\times10^{-4} = 1\times10^{10}\Omega$$

When the photoreceptor is negatively charged by subjecting to corona discharge, the top surface of the photoreceptor is provided with negative charges while the substrate is at positive potential. Since the resistivity of the $SiO_2$ film is high, positive charges are induced not only at the intersurface between CTL and CGL, but also the intersurface between the $SiO_2$ film and the substrate so that an effective field is applied across the CGL.

Figure 2:
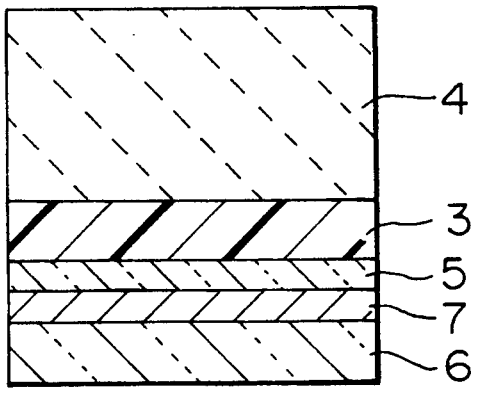
FIG. 2 is a diagrammatical cross-sectional view of a photoreceptor for electrophotography according to another embodiment of the present invention.

A photoreceptor for electrophotography according to another embodiment of the present invention is shown in FIG. 2. A substrate comprising insulating support 6 and an electroconductive layer 7 formed thereon is used instead of the electroconductive support. On the substrate, there is manufactured a structure comprising an under coat layer 5 of silicon dioxide or silicon oxides, containing predominantly $SiO_2$, a carrier generation layer 3 and a carrier transport layer 4, in similar procedure as described above. This structure of photoreceptor for electrophotography can be adapted to the type where the photoreceptor is illuminated from the bottom side of the structure insofar as the insulating support 6 is made of a transparent material such as glass, and the electroconductive layer 7 is made of a transparent electrode such as indium tin oxide (ITO) and the like. When the carrier generation layer is formed directly on the electroconductive film, the resistance in dark (charging characteristic and dark decay characteristic) of the photoreceptor manufactured may be significantly influenced by the magnitude of the work function of the electroconductive film. However, this problem can be overcome by the use of the $SiO_2$ UL to achieve conveniently good electrophotographic characteristics.

The above embodiment of the present invention will be further explained with reference to the following Examples.

EXAMPLES (1) An ITO film was produced on a cleaned glass substrate by sputtering. The ITO film had a resistivity of 300Ω/square and a thickness of about 200 nm.

(2) In addition, on the ITO film, there was formed a $SiO_2$ film having a thickness of about 20 nm by electron beam vapor deposition, to be used as UL layer.

(3) Then, a film of titanyl phthalocyanine (TiOPc) having a thickness of about 100 nm was produced by vacuum vapor deposition with resistance heating, to be used as CGL layer.

(4) The CGL layer was coated with a solution of a combination of a hydrazone based charge transporting agent (CTM) and polycarbonate (PANLIGHT K-1300, available from TEIJIN KASEI) dissolved in methylene chloride at a weight ratio of 0.9:1 by means of a doctor blade to a film thickness of 15 μm after it is dried. The drying was performed at a temperature of 110° C. for 30 minutes.

The resultant photoreceptor for electrophotography was designated Sample No. 5.

(5) As comparison samples, the following four substrates were prepared, on each of which CGL and CTL were formed in this order in the same procedures as in the above (3) and (4) to manufacture photoreceptors:

Sample No. 1 Aluminum substrate

Sample No. 2 Aluminum substrate/polyamide based UL

Sample No. 3 Glass substrate/ITO

Sample No. 4 Glass substrate/ITO/polyamide based UL (6) Each of the Samples 1, 2, 3, 4 and 5 was evaluated for electrophotographic characteristics, i.e., charged potential, dark decay rate and photosensitivity. The results are listed in Table 1.

Charged potential

When the photoreceptor is charged, the resistance of the photoreceptor diminishes as an electric field induced across the photoreceptor become higher. Thus, the amount of electricity to be received and retained by the photoreceptor is limited. In this way, the reduction in the resistance causes a flow of a quantity of electricity through the photoreceptor. Therefore, continuous charging will read into such a state where the further charging causes no increment of the electric field because the charges received in the photoreceptor leak out thereof at the same velocity as that of supplying charges thereto. At such a state, the achieved potential is referred to as charged potential of the photoreceptor. Generally, a photoreceptor drum is rotated at a constant revolution speed with varying an electric current flowing into the photoreceptor while the surface potential of the photoreceptor is measured.

Dark decay rate

D.D.R. represents the ratio of the retained potential after 3 seconds and 10 seconds relative to the initial potential.

In general, a practical amount of charges (of 300 to 800 V as represented by surface potential) is imparted onto the surface of the photoreceptor and the variation thereof in dark is measured to be represented by a rate of variation in the surface potential. For example, in case a surface potential of −500 V at the time of 0 was reduced to −400 V at the time of 3 seconds later, and −300 V at 10 seconds later, the dark decay rate is expressed as D.D.R. (3 sec.)=0.8, and D.D.R. (10 sec.)=0.6. Generally, the potentials after 3 seconds and 10 seconds are employed for representing the potential variation.

Photosensitivity

This means a potential reduction rate when the charged photoreceptor is exposed to light as expressed generally by an intensity of illumination ($\mu W/cm^2$) and a period of time (sec) required for the surface potential to reach one half or one tenth of the initial surface potential of the charged photoreceptor. For example, in case a surface potential of the photoreceptor of −500 V at the time of 0 second is reduced to −250 V by exposing the photoreceptor to an illumination of 1 $\mu W/cm^2$ for one second and to −50 by exposing to the same illumination for 3 seconds, the photosensitivity can be expressed as follows:

$$E\tfrac{1}{2}=1\ \mu W/cm^2\times 1\ sec.=1\ \mu J/cm^2$$

$$E1/10=1\ \mu W/cm^2\times 3\ sec.=3\ \mu J/cm^2$$

Electrophotographic characteristics of each Sample

| Sample No. | Structure | Electrophotographic characteristics: Charged potential [V] | 3 sec | 10 sec | Sensitivity (λ = 780 nm) [μJ/cm²] E½ | E1/10 |
|---|---|---|---|---|---|---|
| 1 | Aluminum substrate | −390 | 0.94 | 0.83 | 0.3 | 0.80 |
| 2 | Aluminum substrate/polyamide UL | −550 | 0.99 | 0.96 | 0.25 | 0.75 |
| 3 | Glass substrate/ITO | −110 | — | — | — | — |
| 4 | Glass substrate/ITO/polyamide UL | −325 | 0.92 | 0.80 | 0.35 | 1.3 |
| 5 | Glass substrate/ITO/$SiO_2$ | −400 | 0.94 | 0.88 | 0.22 | 0.65 |

Sample No. 5 of an Example of the present invention had an excellent charging property of −400 V and a ratio of the retained potential of 88% after 10 seconds relative to the initial potential as dark decay rate (D.D.R.) comparable to or superior to that of the ordinary standard aluminum substrate.

With the arrangement using an insulating substrate such as glass having a transparent electroconductive film such as ITO film formed thereon, the formation of the CGL directly on the transparent electroconductive film produces a lower charge capacity photoreceptor owing to its work function as found from Sample No. 3. In order to cope with such problem, there is generally provided, between the transparent electroconductive film and the CGL, a UL of polyamide and the like, which has a tendency to diminish the sensitivity E1/10, especially in the lower field range due to the film thickness and the like as can be seen from a comparison of Sample No. 4 and Sample No. 1 with aluminum substrate.

In contrast, even with glass substrate, the Examples using the $SiO_2$ UL according to the present invention could achieve a photoreceptor having a higher charged potential, and an excellent dark decay rate (D.D.R.), as compared to those of the case using the polyamide UL, and further a higher sensitivity in E1/10 of 65 $\mu J/cm^2$, i.e., twice as high as the sensitivity of the latter case.

As above, the Samples manufactured with the arrangement according to an embodiment of the present invention was excellent in electrophotographic characteristics such as charging property and sensitivity as evidenced by a higher sensitivity in E1/10 of 65 $\mu J/cm^2$ even in the lower field range.

This is considered to be attributed to the dense pinhole free UL of silicon dioxide or silicon oxides, containing predominantly $SiO_2$, which can inhibit the leak of charges into the substrate (electroconductive film), resulting in the enhancement in the charge capacity of the photoreceptor. Similarly, the improvement in the sensitivity is considered owing to an increase in an efficiency of injecting the carriers generated in the CGL into the CTL under the effective field applied across the CGL, which field is established effectively due to the presence of the underlying $SiO_2$ layer.

Figure 3:
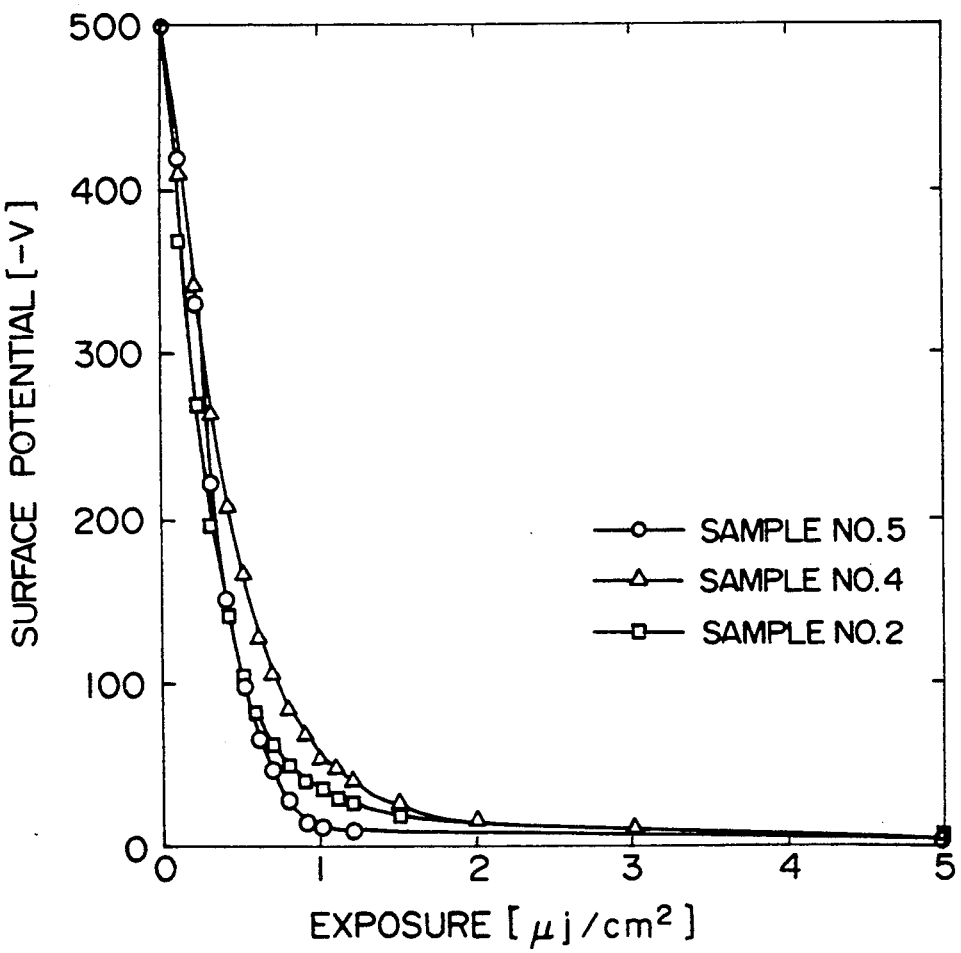
FIG. 3 is a graph showing a comparison of the charge decay property of the photoreceptor for electrophotography according to an embodiment of the present invention with that of the prior art.

The dark decay characteristics of typical samples are plotted in FIG. 3. There are plotted the dark decay characteristics of Sample No. 5 according to an Example of the present invention, Sample No. 2 of a Comparative Example (aluminum substrate/polyamide UL), and another Comparative Sample No. 4 (glass substrate/ITO/polyamide UL). The ordinate represents the surface potential of the photoreceptor and the abscissa represents the amount of light to which the photoreceptor is exposed. The wavelength of the light was 780 nm. It can be said that a better photoreceptor is susceptible to a more prompt reduction in the surface potential with a smaller amount of exposure resulting in a lower remaining potential. As can be seen from FIG. 3, the Sample No. 5 of the Example of the present embodiment indicated a decay to the low potential with the minimum amount of exposure.

As described above, the use of the UL of silicon oxides produced by deposition from the vapor phase enables the pinhole free thin film having a thickness of 1 μm or less to be formed uniformly on the photoreceptor substrate, whereby the electric properties of the photoreceptor for electrophotography is made uniform to produce high quality images. In addition, deposition from the vapor phase can control the combining of Si with O (i.e., composition of silicon oxides) to some extent depending upon its processes and conditions so as to take an intermediate composition between SiO and $SiO_2$. Therefore, the relative permittivity and the resistivity of the film of silicon oxides containing SiO and $SiO_2$ can be varied permitting an optimum design of the photoreceptor for electrophotography. Moreover, since both SiO and $SiO_2$ have a good transmittance in the visible light range, they can be used for the UL of the photoreceptor of the type of electrophotography which is illuminated from the bottom side of the substrate to effectively exposure the CGL, allowing good electrophotographic characteristics to be achieved.

As previously described, the CGL may be formed by the vacuum vapor deposition after the $SiO_2$ UL was formed by deposition from the vapor phase. In such techniques, the UL and the CGL can be continuously formed in a vacuum atmosphere, whereby a good quality photoreceptor can be easily obtained.

Although the present invention has been illustrated with reference to Examples thereof, it is not limited thereto. It should be appreciated that various variations, modifications and combinations are obvious for those skilled in the art.

What is claimed is:

1. A photoreceptor for electrophotography comprising, in order:

a substrate which comprises an electroconductive support or a support having an electroconductive film formed thereon;

an under coat layer including a material selected from a group consisting of silicon dioxide and other silicon oxides formed on said substrate;

a carrier generation layer formed on said under coat layer; and a carrier transport layer formed on said carrier generation layer.

2. The photoreceptor for electrophotography according to claim 1, in which said carrier generation layer is made of titanyl phthalocyanine (TiOPc).

3. A process for manufacturing a photoreceptor for electrophotography comprising the steps of:

forming on a substrate, which comprises an electroconductive support or a support having an electroconductive film formed thereon, a thin film including a material selected from a group consisting of silicon dioxide and other silicon oxides by vapor phase deposition to produce an under coat layer; and then forming on said under coat layer a carrier generation layer and a carrier transport layer in that order.

4. The process for manufacturing a photoreceptor for electrophotography according to claim 3, in which the formation of said under coat layer and said carrier generation layer is performed continuously under vacuum conditions.

5. The process for manufacturing a photoreceptor for electrophotography according to claim 4, in which said carrier generation layer is made of titanyl phthalocyanine (TiOPc).

* * * * *